United States Patent [19]

Smith et al.

[11] 4,190,354

[45] Feb. 26, 1980

[54] COPIER JOB RECOVERY SYSTEM

[75] Inventors: Craig A. Smith, Pittsford; Joachim Guenther, Webster, both of N.Y.

[73] Assignee: Xerox Corporation, Stamford, Conn.

[21] Appl. No.: 956,127

[22] Filed: Oct. 30, 1978

[51] Int. Cl.[2] ..... G03G 15/00; B65H 5/22; B65H 31/08

[52] U.S. Cl. ..... 355/3 SH; 271/3.1; 271/163; 271/212; 355/14 SH; 355/24

[58] Field of Search ..... 355/3 R, 3 SH, 14, 24, 355/26; 271/3.1, 4, 163, 212

[56] References Cited

U.S. PATENT DOCUMENTS

| | | | |
|---|---|---|---|
| 4,026,543 | 5/1977 | Leclere | 271/259 |
| 4,050,805 | 9/1977 | Hage | 355/14 |
| 4,067,649 | 1/1978 | Hubbard et al. | 355/14 |
| 4,087,178 | 5/1978 | Pfeifer et al. | 355/72 |
| 4,116,558 | 9/1978 | Adamek et al. | 355/24 |

*Primary Examiner*—Fred L. Braun

[57] ABSTRACT

Simplexed copy sheets lost during a partially completed pre-collation duplex copying run are automatically replaced in proper serial order into the partial copy set in the duplex buffer set tray by lifting the partial buffer copy set stack up with a false tray bottom and inserting replacement (make-up) simplex copies under the buffer set, then the false bottom is lowered and the duplex copying run, is continued, feeding out sheets from the duplex tray with the existing bottom feeder, and feeding the subsequent simplex copies in normally to the top of the buffer set stack. Thus, the copies in the buffer set do not have to be thrown away or reorganized by the operator when a copier jam occurs.

10 Claims, 1 Drawing Figure

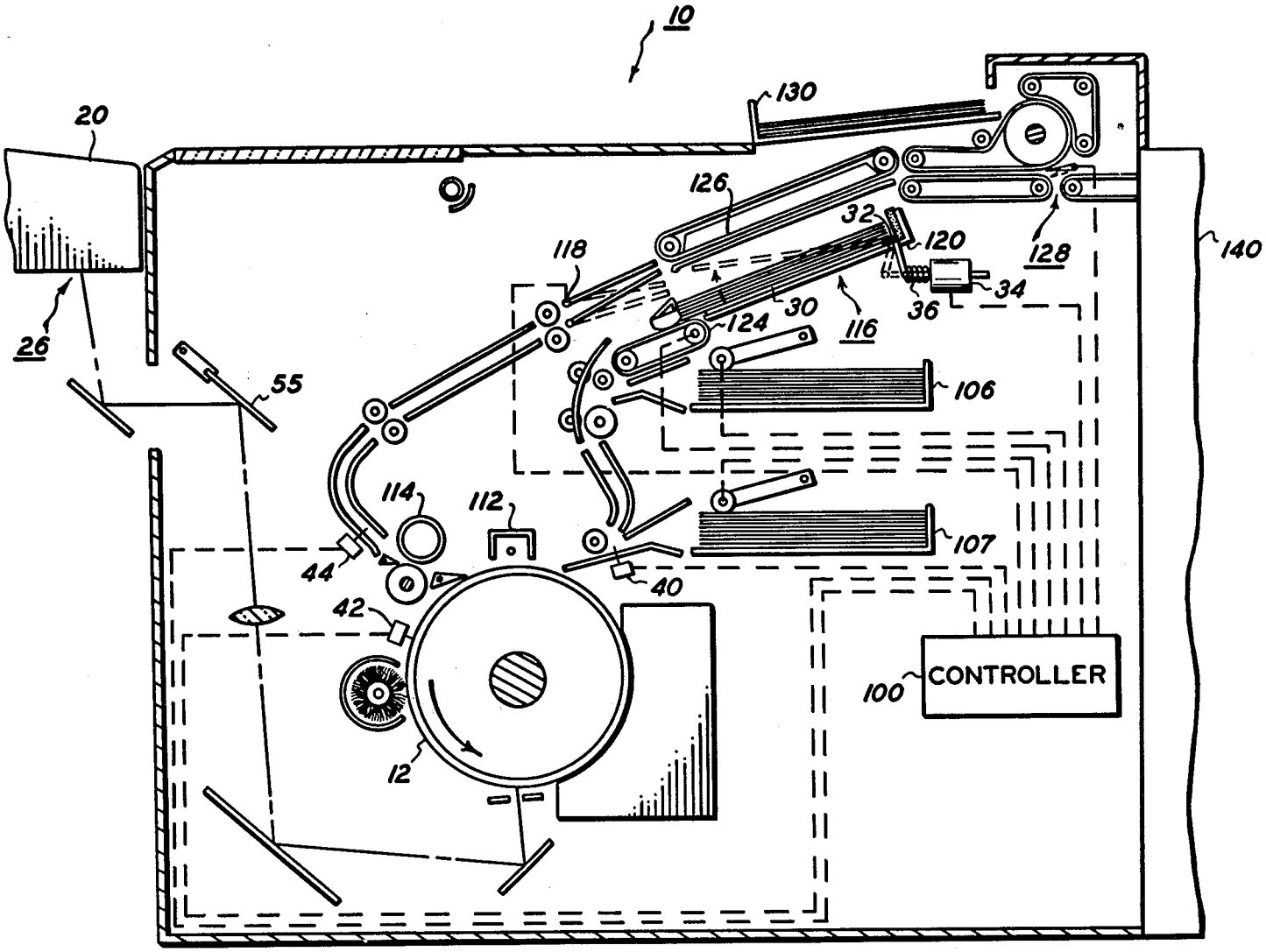
140
128
34
120
36
32
116
30
124
126
130
10
118
106
107
CONTROLLER
100
40
112
114
42
44
12
55
20
26

COPIER JOB RECOVERY SYSTEM

The present invention relates to job recovery for pre-collation duplex copying systems.

As xerographic and other copiers increase in speed, and become more automatic, it is increasingly important to provide more reliable and more automatic control and handling of the copy sheets under copying failure or error conditions, such as copy sheet misfeeds, paper jams, original document misfeeds, etc.. It is particularly desirable to provide automatic "job recovery" systems in which damaged, unexposed, or otherwise "lost" copy sheets are automatically accounted for and replaced with the minimum of operator intervention, and the minimum of interruption in the copying run.

The providing of a pre-collation copying system greatly complicates and increases these copier sheet handling difficulties, because the copies in process are not alike and must be maintained in order. That is, the copy sheets passing through various processing paths in the copier are of different pages of the original document set being copied.

Duplex copying adds even further difficulties to job recovery in a pre-collation copying system because the page images not only must be maintained in order on the various copies, but must be placed on both sides of the copy sheets. The present invention applies to simplex/duplex copying, in which the images on one side of two successive simplex original documents are placed on opposite sides of a single copy sheet, and also to duplex/duplex copying, in which the images on both sides of a duplex document are copied on both sides of a single copy sheet. Further, the present invention is not limited to duplex copying (or "backing-up") from original documents. It is also applicable to duplex copying systems in which a pre-collated series of input images are generated by various electro-optical or other image generators.

The present invention is particularly directed to sequential or dual pass duplexing systems, in which the duplex copies are made by first making a set of simplexed copy sheets (printed on only their first sides) and temporarily storing that set of simplexed copy sheets as a buffer set, and then feeding those simplex sheets back from the buffer set through the copying processor for a second pass in which document images are printed on their opposite sides. Such dual pass duplexing systems have the advantage of being able to utilize a single conventional imaging station, transfer station, and processor of a conventional xerographic copier for both sides of the copies.

Of background interest as diclosing further details of a preferred simplex/duplex precollation copying system is U.S. Pat. No. 4,116,558, based on U.S. Patent Application Ser. No. 767,012, filed Feb. 9, 1977, by J. A. Adamek, et al.. Another desirable pre-collation duplexing copying system is disclosed in U.S. Patent application Ser. No. 825,743, filed Aug. 18, 1977, by T. J. Hamlin, et al.. The advantages of pre-collation copying, further examples, and a listing of various other references related thereto, are disclosed in those cases and in U.S. Pat. No. 3,963,345, issued June 15, 1976, to D. J. Stemmle, et al.

Other art of interest includes U.S. Pat. Nos. 4,026,543; 3,944,794; 3,819,266; and 3,588,472 to Xerox Corporation; U.S. Pat. No. 4,067,649 and 4,026,543 to IBM Corporation; and U.S. Pat. No. 4,076,408 to Eastman Kodak Company, (and U.S. Defensive Publication T957,006). These are exemplary of various references relating to xerographic copier control and logic systems including job recovery and accounting for copy sheet loss in a paper path in general.

U.S. Pat. Nos. 4,087,178, 4,050,805, and 3,767,187, are of interest as disclosing various structures in which all or part of a copy sheet tray or bin is pivotable, and other structures and functions in xerographic copiers.

The art cited also includes discussions of details of suitable or conventional copier components for use with pre-collation duplex copying systems, including automatic document recirculators, xerographic processors, copy sheet feeders, trays and guides, and copier controllers. Accordingly, such conventional details need not be described herein.

The present invention is intended to overcome or minimize the above-discussed and other problems and disadvantages of job recovery in a pre-collation copying system. As disclosed in the following specification example, this can be accomplished by a method and apparatus in which one or more replacement simplexed copy sheets are made up in response to the sensing of lost copy sheets during a duplex copying run, and instead of normally feeding these replacement copy sheets to the first side of a duplex buffer set stack, a space is formed at the opposite or output side of the buffer set stack into which these replacement simplex copy sheets are fed. Then, the normal pre-collation duplex copying run is resumed, with feeding of subsequent simplexed copy sheets to the first side of the buffer set stack, while feeding out the sheets to be duplexed from the second side of the buffer set stack in page order and with the replacement simplex copy sheets being fed out first before the other sheets in the buffer set stack. As disclosed in detail, this can be accomplished in a simple and low cost manner by a movable false bottom buffer tray system.

Further objects, features and advantages of the present invention pertain to the particular apparatus and steps whereby the above-mentioned and other aspects of the invention are attained. Accordingly, the invention will be better understood by reference to the following description and to the drawing forming a part thereof, wherein:

The FIGURE is a side view of an exemplary otherwise conventional xerographic copying apparatus with an automatic pre-collation job recovery system in accordance with the present invention.

The FIGURE illustrates one example of the present invention, and one example of a copier system in which it may be incorporated. There is shown an exemplary copier 10 in a partly schematic view to particularly emphasize the copy sheet path, to which the following description is particularly directed.

Referring first to the conventional or known aspects of the FIGURE, there is shown an imaging station 26 of an appropriate pre-collation recirculating document handling unit 20. This may be of the type disclosed in the above-cited patents or other suitable system for generating a series of individual page images in serial order, repeated by a number of times corresponding to the desired number of copy sets. Also shown in an optics system 55 for imaging each document image onto a photoreceptor 12. The photoreceptor 12 here has the normal xerographic imaging, development, transfer, stripping, and cleaning stations acting thereon to develop the document image on the photoreceptor 12 with fusable toner material and to transfer that toner image to one side of a copy sheet at a transfer station 112. That transferred copy page image is then fused to the copy sheet at the fusing station 114. Clean (unimaged) copy sheets may be fed into the transfer station 112 from either of two copy sheet trays 106 or 107. After the transfer and fusing of the copy sheet image has been accomplished on one side, the copy paper output path here inverts the copy sheet and transports it toward an exit area. However, first it passes by a movable gate or deflector 118. Depending on the position of this sheet deflector 118, the copy sheet will either pass on to a transport 126, or be temporarily captured and stored in a duplex buffer set storage tray or bin 116. These structures are shown in simplified form here to clarify their operation, and it will be appreciated that other structures providing the same function may be substituted.

After the sheets have been duplexed (or if the copier is being operated in a simplex copying mode) the copy sheets exit the copier processor through the output transport 126 rather than being deflected into the duplex bin 116. As shown here, this may comprise a further output transport with a further deflector or gate 128 for selecting between inverted output to a tray 130 or non-inverted output to a conventional finishing station 140, as desired or depending on the copier mode.

Thus, for duplex copying, the copy sheets to be duplexed are deflected by the deflector 118 into the tray 116 after they have been simplexed. That is, those copy sheets from the tray 106 or 107 which have received a page image on one side thereof are deflected into the tray 116 rather than exiting the copier. The tray 116 has a bottom sheet feeder 124 for feeding sheets individually out from the bottom of the tray 116 into a sheet feeding path toward the transfer station 112 for the transfer of the second page (opposite) page image to the second (opposite) side of these previously simplexed copy sheets which were temporarily stored in the buffer set tray 116. It is important to note that the sheet feeder 124 feeds sheets from the opposite side of the buffer set from which the sheets are normally being fed into the buffer set by the deflector 118. Besides providing for non-interferring recirculation, this maintains the proper page order of the simplexed copy sheets in the buffer tray 116.

By way of one example, assume a five page document set is being copied, and that the even pages are being copied first, Page 2 is first copied on one side of a first clean copy sheet and deflected into the tray 116 by deflector 118 in its dashed line position. Then page 4 is copied onto one side of a second copy sheet and placed on top of the first copy sheet in the tray 116. The sheet feeder 124 is then actuated to feed out the bottom sheet from the tray 116, (which is the first sheet one with page 2), to the transfer station 112 where page 1 is placed on the opposite side of that sheet. The deflector 118 is moved by the controller 100 to its raised (solid line) position so that this first sheet, which is now fully duplexed, is ejected from the copier through the output transport path 126, rather than returned to the buffer set tray 116. The sheet feeder 124 then next feeds the second sheet, bearing page 4, out of the tray 116 and the page 3 image is copied on its opposite side, and this second sheet is likewise ejected from the copier. Page 5 may then be copied on a clean sheet fed from tray 106 or 107 since there are no further pages to be duplexed in this exemplary five page document set. It will be appreciated that with a larger document set there would be a corresponding larger number, e.g., fifty, simplexed copy sheets stored and then removed from the tray 116 during each document page set circulation.

While in the above-example the copying system is a 1 to n page order pre-collation copying system with a buffer set of the even pages copied first, it will be appreciated that the present system may also be utilized in a n to 1 order pre-collation copying system, and with either even or odd pages simplexed first.

Considering now in further detail the novel features of the present invention exemplified here, there are shown in the copy sheet paths of the copier, by way of example, jam detectors 40, 42, and 44. These are merely exemplary of various jam detectors located at various points in the input, feeding, stripping, fuser, output, and various other conventional locations. Jam detectors will also preferably be located in the pre-collation document image generator 20. All of these jam or misfeed detectors are conventionally connected to the copier controller 100 to provide a signal indicative of "lost" copy sheets. In response thereto, the controller 100 automatically initiates an automatic job recovery operation as described below.

In response to the sensing of lost copy sheets during a duplex copying run, the controller 100 automatically directs the copier, including the document image generator 20, and the sheet feeders associated with the copy sheet trays 106 or 107, to automatically make-up one or more replacement simplexed copy sheets corresponding to the number, and the correct pages, of the copy sheets which were "lost". For example, in the preceeding example, if the second simplexed copy sheet bearing page 4 was lost (not imaged or not able to be placed in the tray 116), the controller 100, in response to a detection signal, would so indicate. If the problem was a jam in the paper path the controller 100 would provide a diagnostic signal to instruct the operator to remove the jammed sheet from the paper path first. Alternatively, means can be provided for automatically ejecting some or all of the defective or misfed copy sheets from the copier, e.g., into output tray 130, if they can be. After the jam clearance, or if the problem was the non-feeding or non-imaging of a copy sheet or document without a jam, the controller 100 would then automatically continue the operation of the copier and direct the re-copying of that "lost" page 4 image here onto a new, replacement, copy sheet, from tray 106 or 107, which replacement copy sheet is then fed through the copier toward the tray 116.

However, this replacement copy sheet, unlike the normal simplexed copy sheets, is not fed onto the normal (here the top) input side of the buffer set in the tray 116. Rather, as will be described hereinbelow, the make-up sheet (or sheets) is placed on the opposite (here the bottom), output, side of the buffer set, in a position to be fed out by the sheet feeder 124 before the other sheets already in the buffer set. This then enables the normal pre-collation duplex copying run to be immediately automatically resumed, with feeding of all the simplex sheets to be duplexed from the bottom of the buffer set stack in proper page order. With this resumption of normal pre-collation copying after job recovery the duplex run is continued with the normal feeding of subsequent simplexed copy sheets into the first (here top) side of the buffer set stack. I.e., only the replacement or make-up copy sheets are fed into the buffer set at the output side thereof.

As exemplified here, this special arrangement for providing two simplexed sheet inputs to two different sides of the buffer set in the buffer set bin or tray 116 is provided here by the operation of a pivotable false bottom 30 normally overlying the stationary or fixed main bottom 120 of the tray 116. This false bottom 30 is pivoted about a pivot 32 by a solenoid 34, as shown by the movement arrow in the FIGURE. The pivoting may be assisted by a spring counter-balance 36. The pivot 32 is positioned adjacent the edge of the buffer set stacking tray 116 opposite from the sheet entrance edge, which is adjacent the deflector 118.

The false bottom 30 may be constructed of sheet metal, plastic, a wire form, or other suitable light weight sheet stack supporting structure. It is preferably planar and thin so as to normally closely and flatly directly overlie the main tray bottom 120, or be very closely spaced thereabove, as shown in its normal solid line position in the FIGURE. The false bottom 30 terminates short of, or is apertured around, the sheet feeder 124, so that it does not obstruct or interfere with the operation of the sheet feeder 124 either in its normal position or in its raised position (illustrated with dashed lines). With the false bottom 30 in its normal position, and the deflector 118 in its dashed line position, it may be seen that simplexed sheets enter the duplex tray 116 normally and unobstructedly on the top of the buffer set stack as if the false bottom 30 were not even present. I.e., the false bottom does not interfere in any manner with the normal infeeding and stacking of the sheets into the buffer tray. As illustrated by the dashed line positions, when the solenoid 34 is actuated, the pivoting of the false bottom 30 by less than about 20° completely changes the input of sheets to the buffer set by the deflector 118 without requiring any change in position by the deflector 118 (although a different position may be provided, if desired). Since the buffer set is supported on the false bottom 30, the pivoting of the false bottom 30 shifts the entire buffer set stack up away from the main bottom 120. This provides a large space at the bottom side of the buffer set stack between the false bottom 30 and the main bottom 120 into which the replacement simplex sheets can be fed. This space opens at the sheet input side, facing the deflector 118, and converges toward the opposite or pivot 32 end of the buffer tray. In this pivotal movement of the false bottom 30 it may be seen that the input end of the false bottom 30, at the input end of the buffer tray 116, moves from one side to the other of the output of the deflector 118. Thus, all of the sheets fed into the buffer tray while the false bottom 30 is in its raised position are guided into the tray 116 under the false bottom 30. These replacement copy sheets are thus placed on the main tray bottom 120, positioned to be engaged first by the sheet feeder 124.

After the replacement sheets have been fed into the tray 116 in the above-described manner, the false bottom 30 is then promptly automatically lowered. This lowers the previously generated partial buffer set back onto the replacement sheets to form a single stack. The construction of the false bottom 30 and, if desired, the spring counterbalance 36, in such as to not provide any significant resistance to the feeding out of the make-up sheets from the bottom of the stack even though the false bottom 30 has now been lowered down on top of the make-up sheets. Preferably, the bottom sheet feeder 124 is vacuum assisted to assist in the positive attraction and retention of the bottom-most sheet in the stack. Also, if desired, positive flotation air flow can be provided through the main tray bottom 120 and the false bottom 30 to assist the separation of individual sheets and their support and low friction removal from the stack.

It may be seen that with the above-described job recovery system that the same sheet input deflector 118, guiding sheets to the same position, and the same basic buffer set tray unit 116, and the same, single, fixed position bottom sheet feeder 124, can all be conventionally utilized without expensive modifications or duplication. Only a low cost simple secondary stack support 30, moved by a solenoid or a machine cam or other simple mechanism, is needed to provide a new and significant machine function.

It will be noted that with the disclosed system only a relatively small movement of the duplex buffer set, to provide a relatively small space at its output side, is required for the insertion of the make-up sheets. This is because the maximum number of make-up sheets which would normally be inserted is equal only to the number of copy sheets lost in the copy sheet path. This will typically be only one sheet, or at the most not normally more than two or three sheets, depending on the jam location and the copy sheet path length. Likewise, this is all the jammed sheets that will normally be thrown away at most with this job recovery system.

It will be noted that where the original document handler 20 is a recirculating document handler unit with a stack of documents which are fed from the bottom and restacked on the top of the stack after they have been copied, that this same basic concept may be utilized there also. In such a document handler the document feeding jams or misfeeds typically occur on the first sheet or sheets being fed in each document set circulation. Rather than recirculate through the entire stack of documents to put back on the imaging station the one missed, that one document can be returned to the bottom of the document stack rather than the top by lifting the entire document set stack with a similar false bottom tray arrangement. The same advantages are provided of being able to use the same output path and document sheet feeder mechanism. This can expedite the return to the platen or other imaging station of the document which must be recopied to make up the missing copy sheet which is to be placed at the beginning (bottom) of the buffer set as previously described. In such an RDH unit the pivot point of the false bottom would normally be at the sheet feeder side, because the sheet entrance to the document tray in RDH units is typically at the side of the tray opposite from the bottom feeder.

Referring to other possible modifications of the buffer set bin or tray 116, it may be seen that the entrance (and also exit, if desired) of the simplexed copy sheets could be from the opposite end from that shown, i.e., at the end of the tray 116 opposite from the present location of sheet feeder 124. In that case, of course, the pivot 32 for the false bottom 30 would be at the opposite end so as to still open wide at the sheet entrance end of the tray.

As a further possible alternative, although less preferred, the false bottom or upper (inner) stack support could be stationary (fixed) while the lower support surface, corresponding to the present fixed tray member 120, could be pivotably mounted to pivot downwardly away from the false bottom 30. However, if the pivot axis for the support 120 were at the present general position of the pivot 32 the sheet feeder 124 might also have to be pivoted therewith, which is less desirable. If the support surface 120 were pivoted at the output or sheet feeder 124 edge thereof, and the opposite edge was the entrace side for the incoming sheets, either regularly, or for make-up sheets, or both, then, obviously, the end stop or bounce pad illustrated now on the member 120 would have to be removed or modified.

In this disclosed embodiment the tray unit 116 is illustrated in a generally horizontal configuration, slightly sloping downwardly toward the sheet feeder 124 so that the sheets slide downwardly against a front stop adjacent the feeder 124. It will be appreciated that other configurations could be employed. For example, the entire tray unit 116 could be more vertically inclined, with the sheet entrance(s) at the upper end thereof. However, in that case, it may be desirable to provide a movable normal force applicator to hold the stack against the sheet feeder therefrom for positive feeding, e.g., a movable bail or holddown roller arrangement.

While a pivotal, angular, movement of the false bottom 30 is disclosed herein, which allows a simple drive and sheet guiding function, it will be appreciated that other movements may be imparted thereto which provide the desired temporary separation of a partial buffer set in the tray from its normal support surface so as to allow the make-up sheets to be slipped in ahead of the normal sheet sequence at the output side.

The following claims are intended to encompass all such variations and modifications of the invention as fall within the true spirit and scope thereof.

What is claimed is:

1. In a copier adapted for pre-collation duplex copying, in which copy sheets are simplexed and normally fed to a first side of a duplex buffer set stacking means in collated serial page order, where said copy sheets are normally stacked relative to a main supporting surface means and then fed out from the second and opposite side of said buffer set stacking means in serial page order by a first sheet feeding means to be duplexed; a job recovery system for replacing lost copy sheets and continuing pre-collation duplex copying run, comprising:

means for making up one or more replacement simplexed copy sheets in response to the sensing of lost copy sheets during a duplex copying run;

shifting means for temporarily shifting the position of a buffer set stack of copy sheets in said buffer set stacking means relative to said main supporting surface means to provide a space therebetween into which said replacement simplexed copy sheets can be fed at said second side of said buffer set stacking means;

second sheet feeding means adjacent said buffer set stacking means for feeding said replacement simplexed copy sheets into said space;

said shifting means being further adapted to shift said buffer set stack back to its normal position after said replacement copy sheets have been fed into said space;

said second sheet feeding means and said shifting means being adapted to position said replacement simplexed copy sheets in a position to be fed out from said buffer set stacking means by said first sheet feeding means before other sheets in said buffer set stack so as to maintain a precollated buffer set stack in collated serial page order for continued copying.

2. The job recovery system of claim 1, wherein said buffer set stacking means comprises a buffer bin with a main bottom and a normally overlying false bottom, and wherein said false bottom is adapted to normally stack a buffer set of simplexed copy sheets in said buffer bin on said false bottom overlying said main bottom, and wherein said shifting means comprises means for temporarily separating said false bottom from said main bottom sufficiently to form therebetween said space at said second side of said buffer set stack into which said replacement simplex copy sheets are feedable by said second sheet feeding means.

3. The job recovery system of claim 2, wherein said first sheet feeding means is adjacent said main bottom of said buffer bin and is adapted to feedingly engage the bottom sheet of a buffer set stack in said buffer bin when said false bottom is overlying said main bottom, and wherein, when said false bottom is so separated from said main bottom by said shifting means, a buffer set stack thereon is separated from engagement with said first sheet feeding means.

4. The job recovery system of claims 2 or 3, wherein said second sheet feeding means is positioned adjacent, a first, sheet input, edge of said main bottom of said buffer bin, and wherein said false bottom is pivotable by said shifting means about an axis of rotation adjacent a second, and opposite, edge of said main bottom of said buffer bin to provide a converging sheet input space between said false bottom and said main bottom from said sheet input edge of said main bottom.

5. The job recovery system of claim 4 wherein said shifting means comprises solenoid connected to pivot said false bottom.

6. The job recovery system of claim 1, wherein said second sheet feeding means comprises copy sheet guide means positionable with an outlet for guiding simplexed copy sheets toward a position normally corresponding to said first side of said duplex buffer set stacking means.

7. The job recovery system of claim 6, wherein said buffer set stacking means comprises a buffer tray with a main supporting surface and a normally closely overlying, but movable, secondary support surface member against which a buffer set of simplexed copy sheets is adapted to be stacked, wherein said first sheet feeding means is operatively associated with said main supporting surface means, and wherein said shifting means comprises means for temporarily moving said secondary support surface member away from said main supporting surface means sufficiently to form said space at said second side of said buffer set stack into which said replacement copy sheets are feedable by said second sheet feeding means, said secondary support surface member being movable by said shifting means from a normal position at one side of said copy sheet guide means outlet, in which copy sheets stack at said first side of said buffer set stacking means, to a second position, at an opposite side of said copy sheet guide means outlet, in which copy sheets from said copy sheet guide means are deflectable by said secondary support surface member into said buffer set stacking means between said secondary support surface member and said main supporting surface means.

8. A job recovery method for replacing lost copy sheets and continuing a pre-collation duplex copying run in which copy sheets are simplexed and normally fed into a first side of a duplex buffer set stack, which stack is supported at a normal position by a supporting means in serial page order and wherein said simplexed copy sheets are fed out from the second side of the buffer set stack to be duplexed, comprising:

making up one or more replacement simplexed copy sheets in response to the sensing of lost copy sheets during a duplex copying run;

shifting the position of the buffer set stack relative to said supporting means to provide a space at said second side of said buffer set stack into which said replacement simplexed copy sheets can be fed;

then feeding said replacement copy sheets into said space at said second side of said buffer set stack;

then returning said buffer set stack to said normal position relative to said supporting means; and then resuming said normal pre-collation duplex copying run with feeding of subsequent simplexed copy sheets to said first side of said buffer set stack and feeding sheets to be duplexed from said second side of said buffer set stack in order and with said replacement simplex copy sheets being fed from said buffer set stack before the other sheets in said stack.

9. The job recovery method of claim 8, wherein said buffer set stack is stored in a buffer tray, comprising said supporting means, with a main bottom and a normally overlying false bottom, and wherein said buffer set stack is supported by said false bottom, and wherein said shifting of said buffer set stack is accomplished by temporarily separating said false bottom away from said main bottom to form therebetween said space at said second side of said stack into which said replacement simplex copy sheets are fed.

10. The job recovery method of claim 9, wherein said separating of said false bottom from said main bottom is accomplished by pivoting said false bottom by not substantially more than approximately 20° about an axis of rotation adjacent an end of said main bottom from the end into which said replacement sheets are fed.

* * * * *